United States Patent [19]

McDorman et al.

[11] Patent Number: 4,563,010

[45] Date of Patent: Jan. 7, 1986

[54] TRAINING DEVICE FOR GOLFERS

[76] Inventors: Kim C. McDorman, 717 U.S. 1, #606, Jupiter, Fla. 33450; William B. Boyington, 1517 15th Ct., Palm Beach Gardens, Fla. 33410; Ronald K. Wynn, 9164 Sunrise Dr., Palm Beach, Fla. 33410

[21] Appl. No.: 453,623

[22] Filed: Dec. 27, 1982

[51] Int. Cl.[4] ..... A63B 69/36

[52] U.S. Cl. ..... 273/187 R; 273/35 A; 273/183 E

[58] Field of Search ..... 273/187 R, 35 A, 183 A, 273/183 E; 434/252

[56] References Cited

U.S. PATENT DOCUMENTS

| | | | |
|---|---|---|---|
| 1,410,811 | 3/1922 | Lewis | 273/35 A |
| 2,150,580 | 3/1939 | Crowley | 273/187 R |
| 2,169,407 | 8/1939 | Crowley | 273/187 R |
| 3,273,891 | 9/1966 | Grim | 273/163 R |
| 3,934,874 | 1/1976 | Henderson | 273/35 A |
| 3,934,882 | 1/1976 | Whittaker | 273/35 A |
| 4,384,718 | 5/1983 | Cachola | 273/187 R |

FOREIGN PATENT DOCUMENTS

| | | | |
|---|---|---|---|
| 16930 | of 1911 | United Kingdom | 273/187 R |

*Primary Examiner*—George J. Marlo
*Attorney, Agent, or Firm*—Eugene F. Malin

[57] ABSTRACT

A golf teaching device for right- and left-handed golfers to assist in assuming a consistent stance when addressing the ball for a swing. A system of mirrors connected to the base frame allows the golfer to view the position of his body in the stance and to align the framework of the device with the desired target line through a sighting apparatus on the base frame. A club facer assembly allows the golfer to position the face of the club perpendicular with the selected line of flight. Graduations on the device allow the golfer to consistently position and align his feet and the ball with the target line when addressing the ball. An extendable shaft assembly with graduations positions the club facer assembly a desired distance from the golfer in his desired stance. The extendable shaft assembly snaps into position generally perpendicular to the base frame. The position of the shaft assembly on the base frame may be reversed to accommodate right- or left-handed golfers. The club facer assembly may be provided a swing away or retracting configuration. The club facer assembly may also be provided an adjustable club facer bar to square the club face with an altered target line.

13 Claims, 16 Drawing Figures

TRAINING DEVICE FOR GOLFERS

BACKGROUND OF THE INVENTION

1. Classification

This invention relates to golf teaching devices for assisting a golfer in consistently assuming a specific stance for each type of shot, for aligning the stance with the desired line of flight of the golf ball, for aligning the device by line of sight with a target location, and for squaring the face of the club and the bar and desired line of flight.

2. Discussion of Related Art

It has been suggested that to fly dead straight, a golf ball must be struck with the club face looking momentarily directly at the target and the clubhead traveling momentarily along the target line. Any deviation in eithr face alignment or path will produce a proportionate deviation in the ball's flight. It has been recommended by professionals that golfers should aim the bottom line of the club face squarely at the target at address. Since most golfers will arrange themselves square to the facing of the club, by aiming the club face squarely at the target, the chances of properly aligning themselves with the ball to target line (desired line of flight) are greatly increased and therefore the probability of an accurate shot assuming a proper swing.

Regarding the swing, most golfers become so concerned with the goal of an ideal golfing swing and end up without enough concentration on what could be considered to be the two most fundamental objectives in a golf stroke: in the impact zone, moving the club head parallel to the desired line of flight, and maintaining the golf head face perpendicular to the desired line of flight. There are many devices for teaching the golfer where to place his feet, but none of the devices present a totally integrated system for alignment with the desired line of flight of the ball, positioning the feet, assuming a stance, addressing the ball, and squaring the club face with desired line of flight as the instant invention.

SUMMARY OF THE INVENTION

A golf teaching device to require the golfer to consistently assume the same stance when addressing the ball for specific shots and to position the face of the gold club head for proper alignment at the instant of impact. A base frame provides for proper alignment with the desired line of flight of the ball by utilizing a mirror and tandem sights to align the elongated base frame. The base frame has graduations along its length to mark the position and alignment of the feet. Mirrors on the base frame permit the golfer to view the position of his body to insure that he assumes the same position each time. Perpendicular to the base frame is an adjustable extension assembly.

A club facer assembly is attached perpendicular to the extension assembly and generally parallel to the base frame. An extendable shaft of the extension assembly has graduations for positioning the facer assembly away from the base assembly to accommodate the stance and club of the golfer. The club facer assembly includes a channel member generally parallel to the base frame for housing a mirror assembly and club facer member. The miror provides the golfer a visual means to check the position of his head and body to assure a consistent stance. The club facer allows the golfer to address the ball and position the face of the club perpendicular to the desired line of flight. In alternative embodiments, the club facer assembly may be swung away or retracted out of the way, the club facer may be angled, and the front sight may be pivoted to provide convergence of the line of sight and the line of flight at a specific distance. The position of the extendable shaft may be reversed on the base frame to accommodate right or left-handed golfers.

The invention provides an integrated system not present in the market today. The use of mirrors greatly facilitates learning and practicing proper stances by presenting a visual image to be viewed, remembered, and repeated. The size of the device and simplicity of operation permits the device to be used in actual play. The operation of the device in setting it up and utilizing it is simple and requires very little time, which is of great importance when playing an actual course, so as not to delay the game. The size of the device allows it to be carried by the golfer. A more reduced version may be utilized for putting with an alteration for converging the line of sight and line of travel (flight) of the ball at the short distances found in the putting game.

An object of this invention is to provide a golf teaching device to precisely align with a target to consciously and subconsciously teach a golfer to see a desired line of flight and to assume a proper golf stance relative to the device aligned with that line of flight.

Another object of this invention is to provide a golf teaching device to provide consistent visual indicators of the position of the golfer's body when assuming the stance to assist the golfer in properly addressing the golf ball.

Yet another object of this invention is to provide a golf teaching device having a means to align the face of the golf club with the desired line of flight of the golf ball.

Still another object of this invention is to provide a golf teaching device for adjusting the angle between the face of the club and the desired line of flight of the golf ball.

Yet still another object of this invention is to provide a golf teaching device which is portable and may be used in practice and in actual course play.

Yet another object of the invention is to provide a golf teaching device with a means for adjusting the line of sight to intersect the desired line of flight to permit precise aiming of the device in conjunction with the stroke of the ball.

Still yet another object of this invention is to provide a golf teaching device devoted to training basic skills in aiming the shot, addressing the ball, stance, and alignment of the club face with the ball in one device.

Another object of this invention is to provide a golf teaching device which is adjustable to accommodate golfers of varying size and different stances for different shots.

Still another object of this invention is to provide a golf teaching device for providing consistent visual indicators of the stance and club head-ball alignment.

Yet another object of this invention is to provide a golf teaching device which may be utilized by the novice or the professional for playing, developing, and evaluating his game.

Still yet another object of this invention is to provide a golf teaching device which may be utilized in all phases of the game, such as driving with woods, all iron shots, and putting.

Yet another object of this invention is to provide a golf teaching device having a spring activated facer bar to be swung away from or retracted from the impact area prior to the swing without the golfer having to move his feet.

Yet still another object of this invention is to provide a golf teaching device which is simple to construct and use, and is inexpensive to build.

Another object of this invention is to provide a golf teaching device which may be connected to accommodate right- and left-handed golfers.

Other and further objects and advantages of this invention will become apparent upon reading the following specification taken in conjunction with the accompanying drawings.

DESCRIPTION OF THE PREFERRED EMBODIMENT

Figure 1:
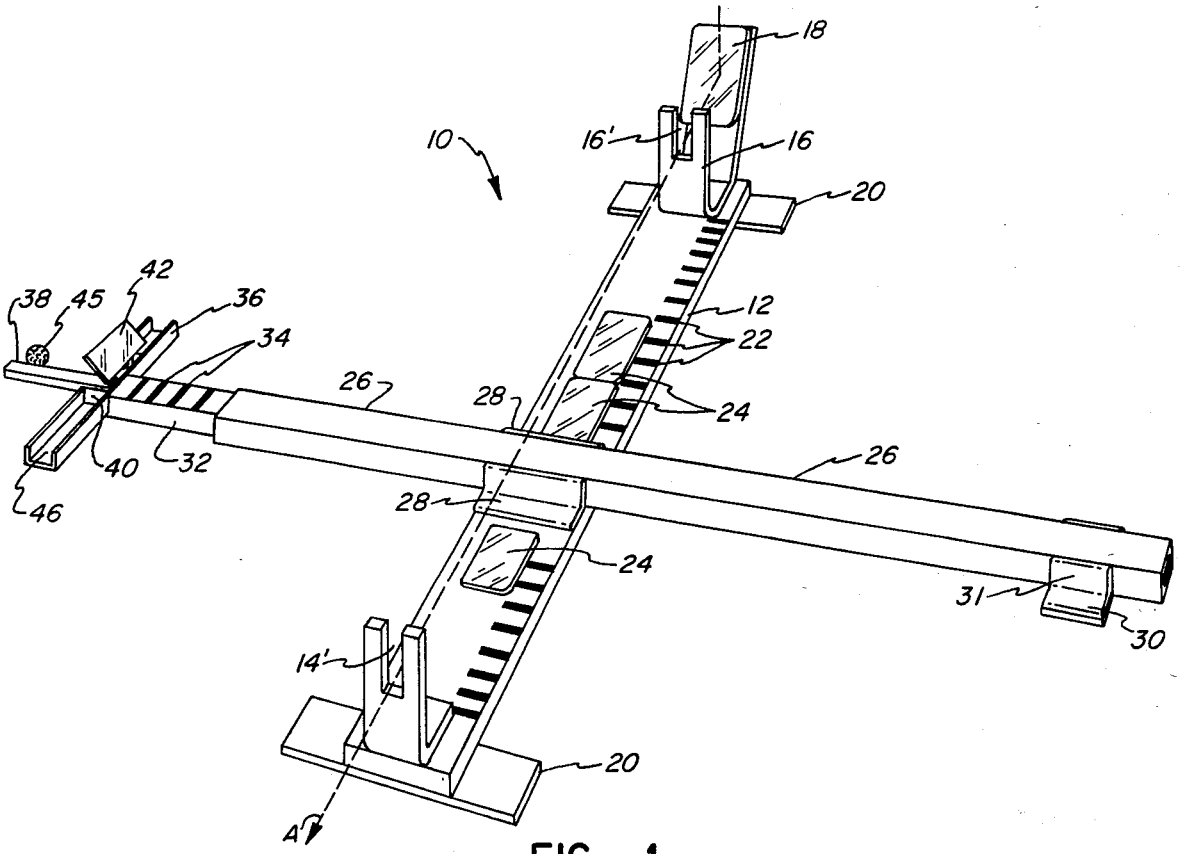
FIG. 1 is a perspective view of the invention.

Now with reference to the drawings, a golf training device is shown and generally referred to by the reference numeral 10 to be described in detail below.

Figure 2:
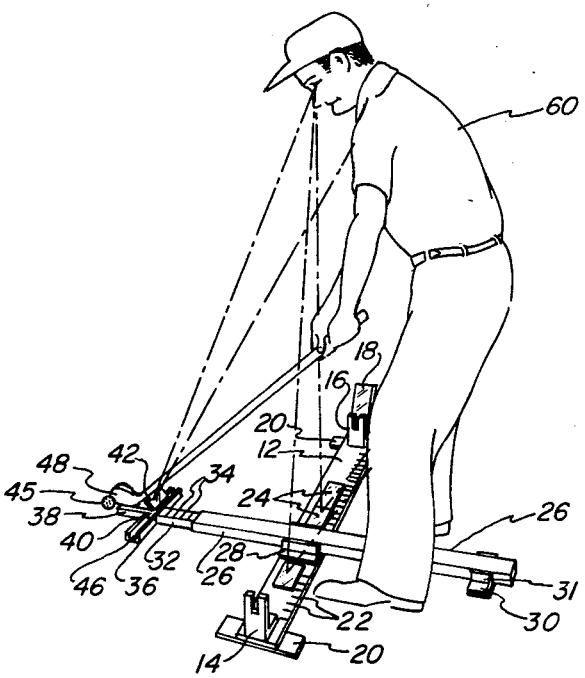
FIG. 2 is a perspective view of a right-handed golfer utilizing the invention.
Figure 3:
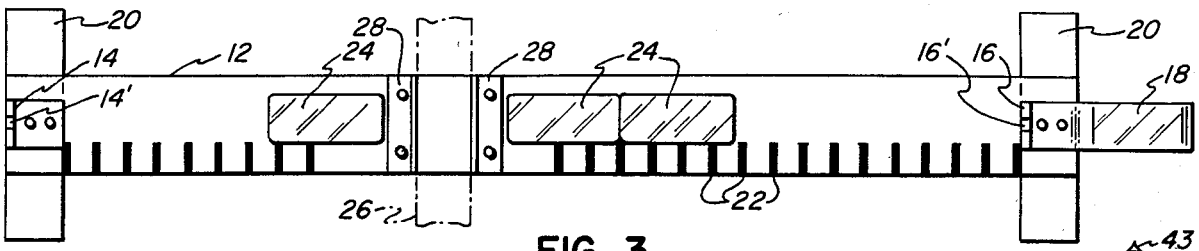
FIG. 3 is an overhead plan view of the base frame member.
Figure 4:
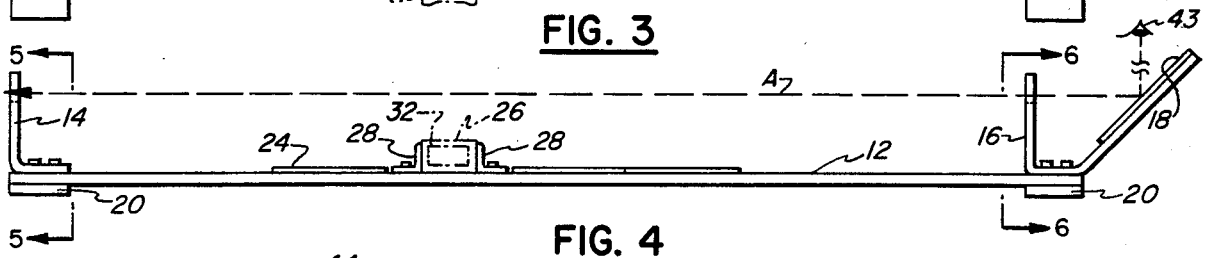
FIG. 4 is a side elevational view of the invention.
Figure 10:
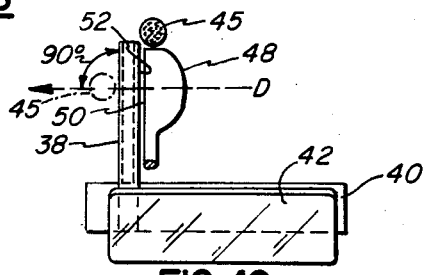
FIG. 10 is an overhead plan view of the club facer assembly of the invention.
Figure 12:
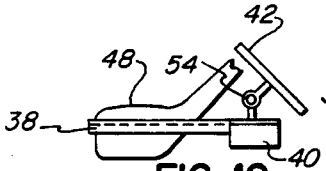
FIG. 12 is a side elevational view of the club facer assembly of the invention.
Figure 11:
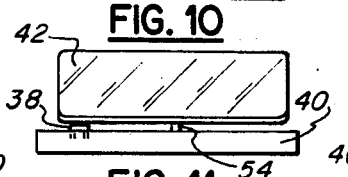
FIG. 11 is a front elevational view of the club facer assembly of the invention.
Figure 13:
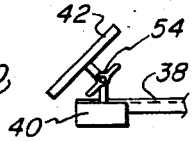
FIG. 13 is an opposing side elevational view of the club facer assembly of the invention.

With particular reference to FIGS. 1, 2, 3, and 4, the golf training device 10 will be seen to include an elongated base frame member 12 for general alignment with a desired line of flight of a golf ball 45. A sighting means providing a generally horizontal line of sight view permits alignment of base frame member 12 generally parallel to the desired line of flight of a golf ball. Frame member 12 has two or more foot pads 20 to stabilize placement of the device 10 on the ground with member 12 in a generally horizontal position. A line of sight apparatus is connected at each end of elongated member 12 generally aligned with the longitudinal axis of member 12 comprising generally vertical sight members, front sight 14 and rear sight 16, having apertures 14' and 16', respectively, for providing a line of sight generally horizontal and along the horizontal axis of member 12. To the rear of rear sight 16 is inclined sighting mirror 18 connected to member 12. Mirror 18 is inclined at an angle away from rear sight 16 to permit a person to stand over the mirror 18 and view the apertures of the sights 16 and 14 in horizontal alignment. The sight picture presented by the apertures and mirror 18 may be horizontally manipulated by movement of member 12 to position the member 12 in parallel alignment with the desired line of flight of a golf ball. The mirror 18 allows the golfer to align the member 12 while remaining standing over the device 10. Graduated markings 22 are placed along the length of member 12 to provide reference marks for placement of the golfer's feet. A plurality of horizontal mirrors 24 are fastened along member 12 at positions to allow a golfer in a stance over device 10 (as shown in FIG. 2) to view portions of his body relative to device 10. In an alternative embodiment, the mirrors 24 are inclined toward the golfer and further may be adjusted in tilt to accommodate any stance. A hollow sleeve member 26 is connectable to member 12 at a right angle by flush press-in cooperation with a pair of retaining flanges 28. Retaining flanges 28 are fastened to member 12 at a position approximately midway between the ends of member 12. Sleeve member 26 has at least one foot pad 30 to provide support to maintain sleeve member 26 generally horizontal and in the same plane with member 12. Sleeve 26 is adjustably mounted between flanges 28. Sleeve 26 may be provided with graduated markings to standardize relative positioning of sleeve 26 with respect to an extension shaft member 32 mounted in slidable co-axial cooperation with sleeve 26. Extension shaft member 32 extends and retracts to adjustably position the club facer assembly (discussed below) away from member 12. The extension assembly, consisting of the sleeve 26 and shaft member 32, may be reversed in position on base member 12 to place the club facer on opposite sides to accommodate a right-handed golfer (FIGS. 1 and 2), or a left-handed golfer (not shown). Shaft 32 may be provided with a plurality of graduated markings 34 to pre-set the extension of shaft 32. A fastening means (not shown) may be provided to retain the shaft 32 at a selected position relative to sleeve 26. A club facer assembly comprises a facer alignment member 36, attached perpendicular to shaft 32, and a club surface facer bar 38. Facer bar 38 is coaxial with shaft 32 and perpendicular to alignment member 36 and member 12; alignment member 36 is generally parallel to member 12. Member 36 has a channel 46 or other means for slideably accommodating the foot 40 (see FIGS. 10, 11, 12, and 13) of the club facer assembly parallel to member 12. Facer bar 38 is connected perpendicular to slidable block or foot 40 and has a surface perpendicular to member 12 (see FIG. 10) for alignment of the club face surface (see FIGS. 10 and 12) perpendicular to member 12, which is parallel to the desired line of flight. The club facer assembly may be withdrawn from the position of ball 45 and club head 48 by telescopic retraction of the shaft 32 within sleeve 26. In an alternative embodiment, this retraction may be assisted by a biasing means such as a spring pulling shaft 32 back into sleeve 26. This embodiment is not shown in the figures. A triggering mechanism for the biasing means would be provided which could be tripped by pressure from the club head 48. A mirror 42 is adjustably attached to foot 40 to provide a visual indication of the position of a golfer's head or other portion of his body relative to his position (golf stance) over the device 10 (see FIG. 2).

Figure 5:
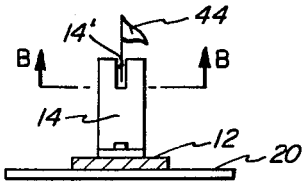
FIG. 5 is a forward elevational view of the invention along axis 5—5 shown in FIG. 4.
Figure 6:
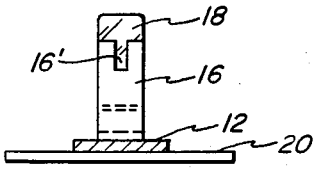
FIG. 6 is a rearward elevational view of the invention along the axis 6—6 shown in FIG. 4.
Figure 7:
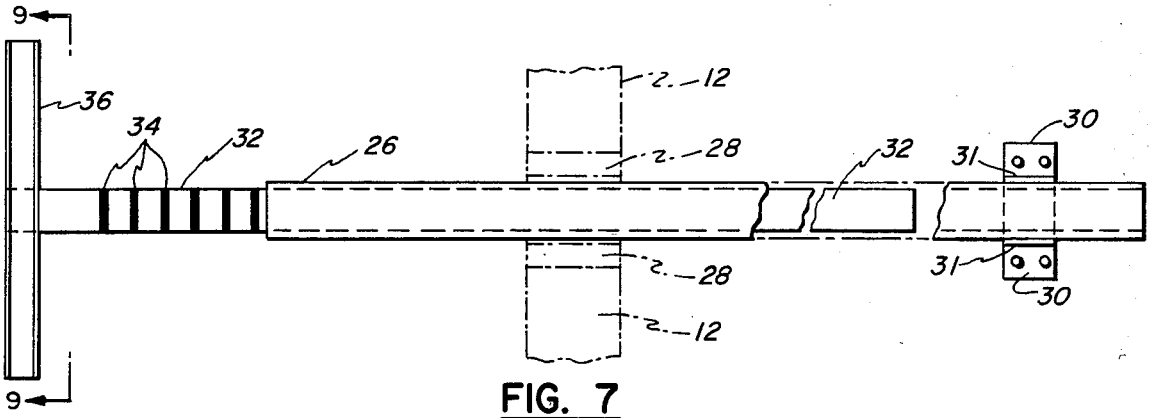
FIG. 7 is an overhead plan view of the sleeve and extendable shaft members of the invention.
Figure 8:
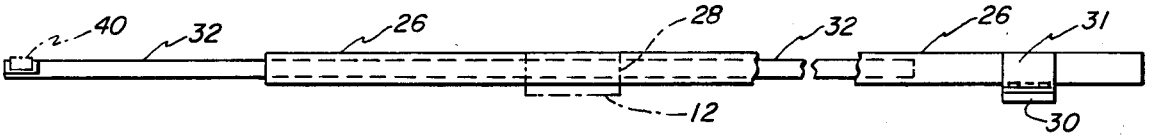
FIG. 8 is a side elevational view of the sleeve and extendable shaft member of the invention.
Figure 9:
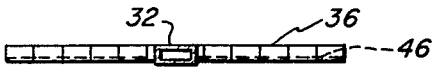
FIG. 9 is a front elevational view of the facer alignment member of the invention.

FIG. 5 shows a line of sight through the aperture 14' of sight 4 toward the desired position (target), such as golf pin 44, which would be down a fairway of a golf course from the position of a golfer utilizing device 10. FIG. 6 shows a view toward the rear sight 16 and mirror 18. The ideal line-of-sight A (shown in FIGS. 1 and 4) would result from proper alignment of the apertures 14' and 16' with mirror 18 as seen by the eye 43 of a golfer standing above the mirror 18. The view presented in line-of-sight A would be the pin 44 (the target) generally centered in the aperture 14' and 16'. This would place the member 12 in alignment with pin 44. At greater golfing distances, the acceptable target line of a golf ball from this position would be parallel to the line of sight notwithstanding the perpendicular off-set distance between the golf ball 45 and the line-of-sight A. At shorter distances, in order to place the target line of the ball onto the pin, it is necessary to displace the line of sight to the side of the pin equal to the off-set distance or compensate by using an alternative embodiment (FIG. 16) which causes the target line to intersect a point along the line of sight at a specific distance such as at the pin 44. At great fairway distances, the off-set distance may not be a relevant factor and therefore the line of sight may be placed on the desired (target) position. FIGS. 7, 8, and 9 show the extension assembly slideable in and perpendicular to member 12. Shaft 32 is slideably operating within the hollow portion of sleeve 26. Foot pad 30, connected to sleeve 26, attaches to sleeve 26 by a pair of flanges 31 and provides support to sleeve 26 and maintains the extension assembly level. A plurality of graduated markings 34 indicate the relative extension of shaft 32 out of sleeve 26. Facer alignment member 36 connects perpendicular to shaft 32 and is attached by a common fastening means.

FIG. 7 reveals facer alignment bar 36 having a channel 46 for slideably accommodating foot 40 of the club facer assembly. The relative position of other components previously described are shown.

FIGS. 10, 11, 12, and 13 show the club surface facer assembly having foot 40, and facer bar 38 with a club head 48 having a club surface 50 for impacting a golf ball in juxtaposition to the facer bar 38. Surface 50 is positioned generally parallel to the perpendicular edge 52 of bar 38 to align the surface 50 perpendicular with the desired line of flight. Mirror 42 is adjustably attached to foot 40 by a common adjustable mounting means 54 to provide vertical angular adjustment to mirror 42. Means 54 allows mirror 42 to be adjusted angularly toward a golfer (as in FIG. 2) to provide the golfer with a means to obtain visual indications of his stance position.

FIG. 2 demonstrates the proper utilization of the golf teaching device either in establishing the correct stance or practicing same. Golfer 60 positions the base frame member 12 adjacent to a golf ball 45 and orients device 10 by looking down into mirror 18 and aligning the rear sight 16 with front sight 14 on the desired line of sight generally corresponding with the desired line of flight of the golf ball 45. Sleeve 26 is mounted in position between the pair of retaining flanges 28.

Shaft 32, with markings 34, is inserted into sleeve 26 and then extended to place facer alignment member 36 away from the member 12 a desired distance. A locking device (not shown) may be used to hold shaft 32 in position in sleeve 26. The club surface facer bar 38 is slid fore and aft in channel 46 of member 36 to place the bar 38 directly in front of ball 45. In practice, the facer bar 38 may be slid fore and aft to accommodate a stance for hitting ball 45 from the rear foot, the front foot, or generally centered with the golfer. In actual play, the facer bar should be positioned for which above shot is selected and then device 10 oriented to accommodate the desired shot. The mirror 42 is then angled at a predetermined disposition to present the desired image for a specific stance.

Golfer 60 then will square the club surface 50 of club head 48 against surface 52 of facer bar 36. It will be observed that nearly all woods have an open look when they are actually square due to blending back the top of the wood club face toward the toe of the club. Also, normally woods have a radius of 6" to 8" across the face. The golfer 60 will also center the contact point (on radiused clubs) directly behind the ball. Then the golfer 60 checks the mirror 42 for "eye-to-eye" contact to place his head slightly behind the ball 45. With the mirror 42 (eye-to-eye mirror) the shoulder plane or tilt, or parallelism with respect to the ground and device 10 will be visible and the golfer 60 can set his shoulders on his desired plane.

Golfer 60 then looks at this line from behind the ball and steps up and straddles sleeve 26 to place his feet adjacent markings 22 in his normal address position and notes the respective marks for spacing and alignment for future reference. This drill will help aiming from memory later without assistance of device 10. A marker (not shown) may be attached to member 12 adjacent to the markings 22 to indicate the orientation and position of the feet. Golfer 60 then looks into mirrors 24 to check the attitude or position of his knees, hands, shoulders, and preliminarily to check the position of his head.

Now the golfer 60 can make what is called in golfing terms a waggle or start a take-away and look back to the facer bar 38 and recheck what has moved or what moves as he does this. He can even check in the mirror 42 his club position at the top of his swing. The club facer assembly can be retracted or extended by manipulation of shaft 32. When the golfer is prepared to hit the ball, the club facer assembly may be removed from the impact zone (area forward and rear of the ball along the axis of the desired line of flight which is within the strike of the golf club head) by retracting the shaft 32 back into sleeve 26 or by releasing the latching mechanism of the embodiment in FIG. 14. As the golfer progresses in squaring the club head, he may dispense with utilizing the facer club assembly and utilize the device 10 primarily for practicing the stance. Once the stance is mastered, the device 10 may be utilized solely for aligning the stance with the target such as the pin. Later, the device 10 may be utilized for practice, refresher training, and to evaluate deficiencies in performance by reviewing the stance and address drills as set forth above.

Figure 14:
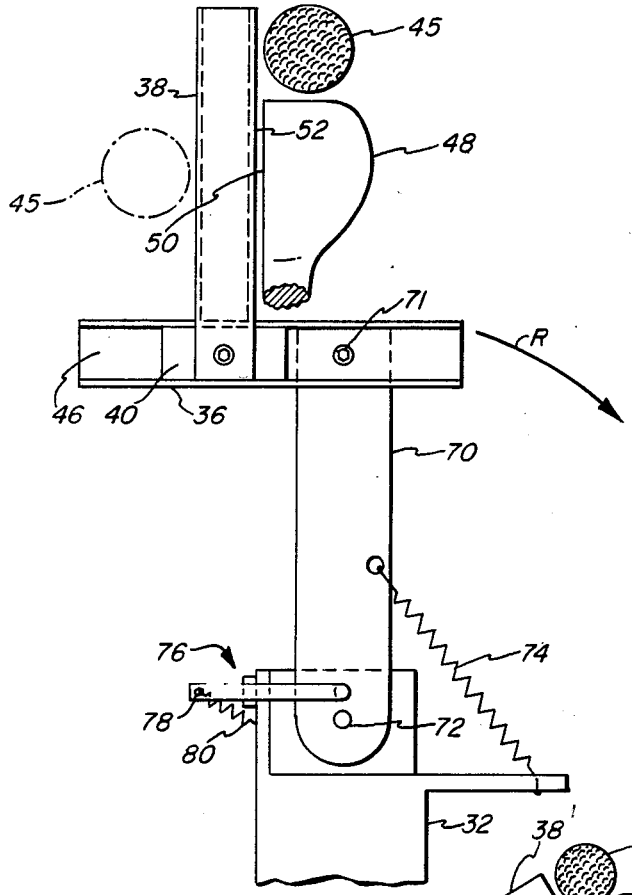
FIG. 14 is an overhead plan view of an alternative embodiment of the club facer assembly of the invention with a pick-away feature.
Figure 15:
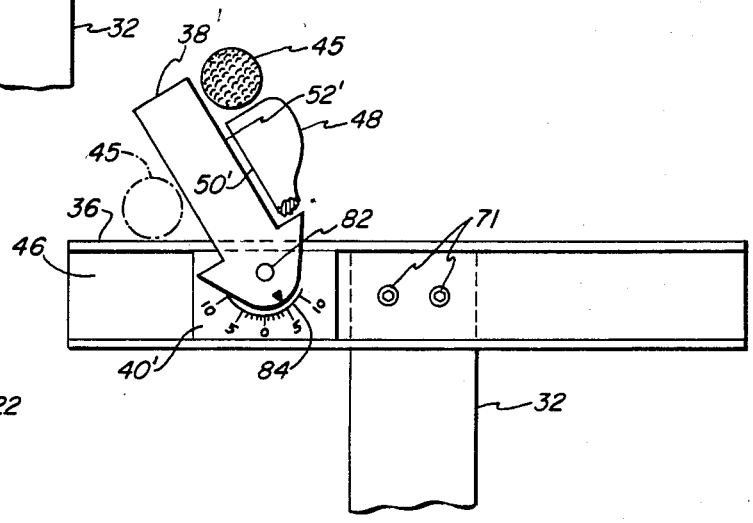
FIG. 15 is an overhead plan view of an alternative embodiment of the club surface facer bar of the invention having an adjustable facer bar feature.

In an alternative embodiment shown in FIG. 14, the club facer assembly is rigidly mounted at one end of an extension member 70 by a common fastening means 71. Member 70 will usually be connected to alignment member 36 at the midpoint of member 36 but is shown in an alternative position connected off-set from the midpoint of member 36. Ball 45 is shown in several alternative positions for alignment with the facer bar 38 and club head 48. Ball 45 (in phantom) allows the facer assembly to be swung away without having to move the ball. The similar situation is shown in FIG. 15. The opposing end of member 70 is mounted co-axially to shaft 32. Member 70 is pivotally mounted to shaft 32 at pivotal point 72 by a rotatable fastening means. Member 70 is rotatably biased about point 72 by a common biasing means such as spring 74. Member 70 is held in a fixed position against the bias of spring 74 co-axially with shaft 32 by a common trip lever assembly means 76 to maintain facer alignment member 36 parallel with member 12. Trip lever assembly means 76 includes a latching lever 78 for engaging the member 70 and resisting the biasing force of spring 74, and a latching spring 80 connected to the latching lever 78 to maintain lever 78 in its engaged position. Member 70 is released upon tripping the latching lever 78. The tripping of latching lever 78 may be accomplished by different configurations of the tripping means 76. One configuration would provide for lever 78 to be released upon impinging pressure upon the lever 78 by such items as the club head 48. This could be done by the golfer without having to move his stance. In another configuration, the club 48 is impinged against bar 38 during the golfer's forward press (preliminary movement prior to beginning swing) causing slight forward movement of the bar 38 and the entire facer assembly thereby releasing lever 78 and allowing the facer assembly to rotate away in direction R. Upon release of latching lever 78, the biasing force of spring 74 will cause member 70 to rotate about point 72 and the club facer assembly to rotate out of the way to enable the golfer to strike a ball positioned adjacent to the former position of the facer bar 38. Member 70 can be configured to rotate and swing away either to the left or right. Latching lever 78 may be activated by contact with a golf glove to prevent the golfer from relinquishing his stance. Facer bar 38 is connected to foot 40 which slideably travels within channel 46 while remaining generally perpendicular to member 38 and member 12. Member 36 is mounted on top of member 70 to allow complete deployment along member 32. Mirror 42 (not shown) is connected to foot 40 and also swings out of the way upon rotation of member 70. Any common means may be used to rotate the club facer assembly out of the way.

In an alternative embodiment of the club facer assembly, as shown in FIG. 15, the facer bar 38' is rotatably mounted to a block or foot 40' similar to foot 40 alone, at point 82 by a common rotatable fastening means. Bar 38' may be rotated left or right to increase or decrease the angle formed with member 36 to open or close the face of the club (not shown) when placed square against facer bar 38'. Foot 40' has graduated markings 84 right and left of the centered position to properly regulate the angle on the face. Foot 40' still slideably cooperates within channel 46 so that foot 40' travels generally parallel to member 12 and perpendicular to shaft 32. Mirror 42 (not shown) is adjustably connected to foot 40' as it was to foot 40. The embodiment of foot 40' and 38' may also be utilized in the swing-away embodiment of the club facer assembly shown in FIG. 14.

Figure 16:
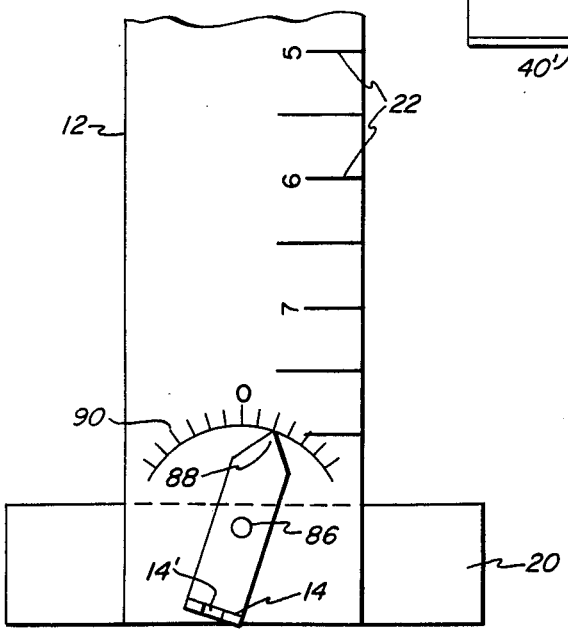
FIG. 16 is an overhead plan view of an alternative embodiment of the front sight of the invention having a convergence feature.

In an alternative embodiment as shown in FIG. 16, the front sight 14' is rotatably mounted on point 86 to provide for movement of the front sight 14' to allow convergence between the selected line of sight and desired line of flight of the golf ball. This embodiment compensates for the parallelism which exists in the orthodox embodiment of the invention as shown in FIGS. 1, 2, 3, and 4. This convergence is a critical factor at the shorter distances where it is desirable to place the ball on the green as close to the pin as possible. The foot of the sight 14' rotates about point 86 and has a pointer 88 at one end to indicate the relative position of the sight to a center or "O" position. Graduated markings 90 indicate the relative movement of the line of sight caused by the rotation of sight 14' and can be calibrated to indicate at what distance the line of sight and line of flight will converge.

The objectives of my invention are met by the foregoing. The described invention is not limited to the exact details of embodiments shown. Included are those modifications thereof which will occur to those skilled in the art upon disclosure of this invention and which fall within the scope of my invention.

We claim:

1. A golf teaching device comprising:

an alignment assembly having a longitudinal axis and provided with a sight means for permitting a golfer, while addressing a golf ball, to see a substantial distance forwardly of the golfer along a line generally parallel to the desired flight of a golf ball;

an extension assembly adjustably attached to said alignment assembly;

a golf club facer assembly; and means for adjustably attaching said golf club facer assembly to said extension assembly for aligning the face of a golf club perpendicular to the desired line of flight established by the alignment of said assembly and for positioning said golf club facer assembly at a desired distance from said alignment assembly.

2. A golf teaching device as set forth in claim 1, wherein:

said sight means is connected to a generally horizontal elongated base frame member for aiming a longitudinal axis of said base frame member along a line of sight generally parallel to the desired line of flight of a golf ball from said golf teaching device.

3. A golf teaching device as set forth in claim 2, wherein:

said extension assembly includes an extension member slideably connected to a sleeve member, said sleeve member connectable to said base frame member horizontally at a right angle, said sleeve member connected to said base frame member approximately at the middle of said base frame member, said extension member slideably connected to said base frame member horizontally, said extension member adjustably extends perpendicular to said base frame member, said extension member having graduated markings thereon.

4. A golf teaching device as set forth in claim 3, wherein:

said facer assembly includes a facer alignment bar and a club surface facer bar, said facer alignment bar connected to said extension member at a right angle horizontally generally parallel to said base frame member, said club surface facer member perpendicular to said facer alignment bar, said club surface facer member having a surface perpendicular to the desired line of flight of the golf ball, said club surface facer member slideably connected to said facer alignment bar having said club surface facer bar perpendicular to the desired line of flight of the golf ball at all positions along said facer alignment bar.

5. A golf teaching device as set forth in claim 4, wherein:

stance positioning means including graduated markings are provided on said base frame member, said base frame member having marking means for marking the position and alignment of the feet of a golfer standing adjacent said base frame member and straddling said sleeve member.

6. A golf teaching device as set forth in claim 5, wherein:

said stance positioning means includes an adjustable mirror connected to said club surface facer member for sighting by the golfer of a specific portion of the golfer's body each time he assumes a specific golfing stance for consistent positioning of the body in conjunction with said golf teaching device, said mirror being adjustable to accommodate differing heights of golfers and extensions of said extension member.

7. A golf teaching device as set forth in claim 6, wherein:

said stance positioning means includes a mirror connected to said base frame member for providing an additional sighting by the golfer of a specific portion of the golfer's body each time he assumes a specific golfing stance for consistent positioning of the body in conjunction with said golf teaching device.

8. A golf teaching device as set forth in claim 7, wherein:

said facer assembly having a means providing releasable, pivotal connection with said extension assembly to rotate said facer assembly means on demand out of the zone of impact of the golf ball and golf club head, said pivotal connection means having a biasing means for forcing said facer assembly means to rotate.

9. A golf teaching device as set forth in claim 7, wherein:

said club surface facer bar having a pivotal means for providing an adjustable angular relationship between said club surface facer bar and said facer alignment member, said pivotal means connected to said facer alignment member.

10. A golf teaching device as set forth in claim 7, wherein:

said alignment assembly having a means altering said line of sight to provide for convergence of said line of sight with a desired point along a target line between said club surface facer bar and a target.

11. A golf teaching device as set forth in claim 1 wherein:

said sight means includes a pair of linearly aligned sight means.

12. A golf teaching device as set forth in claim 1 wherein:

the alignment assembly includes an elongated flat strip;

said sight means comprises a pair of linearly aligned sight means mounted at the opposite ends of said strip and extending vertically upward therefrom, and a reflecting surface disposed on said strip and located adjacent one of said pair of said sight means;

said pair of sight means and said reflecting surface being so associated and arranged that a golfer can see the reflected images of said pair of sight means in the reflecting surfaces, thereby permitting alignment of said golf ball with a golf pin in a hole of said golf course.

13. A golf teaching device comprising:

an elongated horizontal central base frame member, said base frame member having graduated marks, said base frame member having one or more mirrors connected generally horizontally to said base frame member;

a sighting apparatus connected to said base frame member, said sighting apparatus includes a front sight, rear sight, and an inclined mirror to the rear of said rear sight, said front sight and rear sight having linearly aligned sight apertures in mutual alignment with said inclined mirror, said sighting apparatus having a line of sight generally along the longitudinal axis of said base frame member;

an extension assembly perpendicular to the longitudinal axis of said base frame member, said extension assembly having an adjustable, extending shaft perpendicular to said base frame member;

a facer bar;

a housing bar having a channel for slideable cooperation with said facer bar, said housing bar connected to said extending shaft horizontally at a right angle, said facer bar connected to said housing bar at a right angle, said facer bar having a surface generally vertical and perpendicular to said base frame member; and a mirror connected to said facer bar, said mirror adjustable in the vertical plane.

* * * * *